United States Patent [19]

Marovskis

[11] Patent Number: 5,076,457

[45] Date of Patent: Dec. 31, 1991

[54] FOLDING CRATE FOR HOLDING PACKAGES

[75] Inventor: Harijs B. Marovskis, Plymouth, Minn.

[73] Assignee: Tetra Pak Holdings S.A., Pully, Switzerland

[21] Appl. No.: 535,341

[22] Filed: Jun. 12, 1990

Related U.S. Application Data

[63] Continuation-in-part of Ser. No. 369,848, Jun. 22, 1989.

[51] Int. Cl.[5] ..... B65D 7/24

[52] U.S. Cl. ..... 220/6; 220/1.5

[58] Field of Search ..... 220/6, 4 F, 1.5; 206/509

[56] References Cited

U.S. PATENT DOCUMENTS

| | | | |
|---|---|---|---|
| 3,231,084 | 1/1966 | Kean, Sr. | 220/1.5 X |
| 3,250,434 | 5/1966 | Howlett . | |
| 3,424,365 | 1/1969 | Venturi . | |
| 3,557,855 | 1/1971 | Weingarten et al. | 220/1.5 X |
| 3,819,044 | 6/1974 | Bockenstette | 206/509 X |
| 3,865,239 | 2/1975 | Herolzer et al. | 206/509 X |
| 3,874,546 | 4/1975 | Sanders et al. . | |
| 4,044,910 | 8/1977 | Box . | |
| 4,235,346 | 11/1980 | Liggett . | |
| 4,300,695 | 11/1981 | Hsu | 220/6 |
| 4,320,845 | 3/1982 | Waller | 206/509 X |
| 4,674,647 | 6/1987 | Gyenge et al. . | |
| 4,693,386 | 9/1987 | Hughes et al. . | |
| 4,735,331 | 4/1988 | Keenan et al. . | |
| 4,775,068 | 10/1988 | Reiland et al. . | |
| 4,781,300 | 11/1988 | Long . | |
| 4,863,056 | 9/1989 | Inayama . | |

FOREIGN PATENT DOCUMENTS

| | | |
|---|---|---|
| 1108600 | 4/1968 | United Kingdom . |

*Primary Examiner*—Steven M. Pollard

*Attorney, Agent, or Firm*—Burns, Doane, Swecker & Mathis

[57] ABSTRACT

A folding crate includes a bottom having a substantially planar support surface for receiving packages, a first side wall and a second side wall. A first hinge arrangement is provided for hingedly connecting the first side wall to the bottom and a second hinge arrangement is provided for hingedly connecting the second side wall to the bottom. The hinge arrangements permit the first and second side walls to be folded inwardly toward the bottom when packages are not located in the crate. The hinge axis of the first and second hinge arrangements are positioned at elevationally different positions to that the first and second side walls can be folded inwardly toward the bottom and positioned substantially parallel to one another.

32 Claims, 9 Drawing Sheets

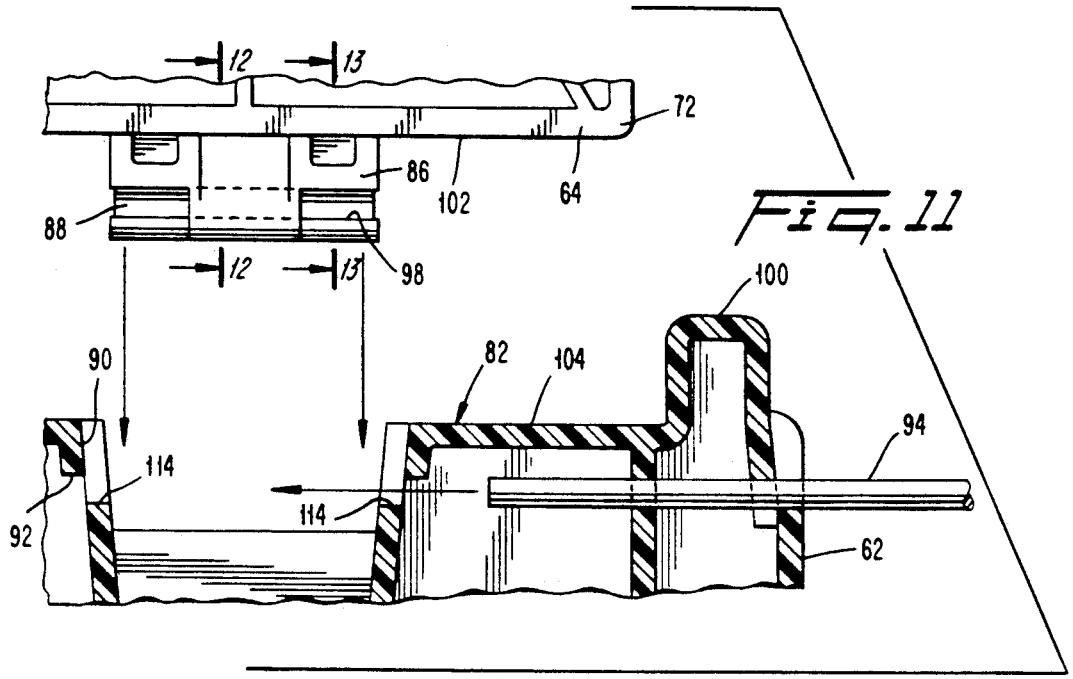
Fig. 11
Fig. 12
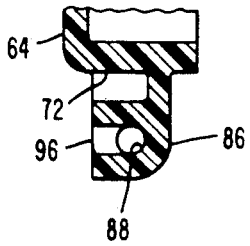
Fig. 13
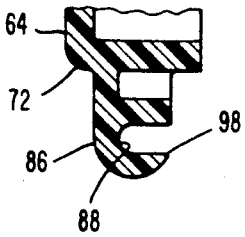
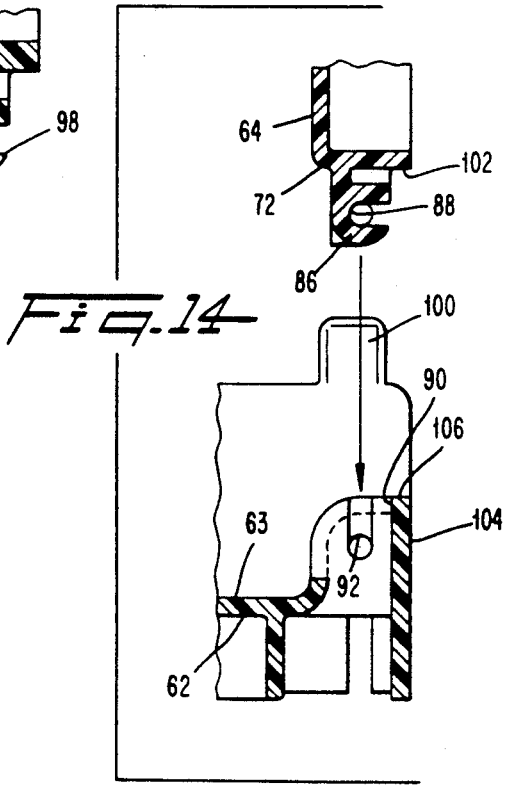
Fig. 14
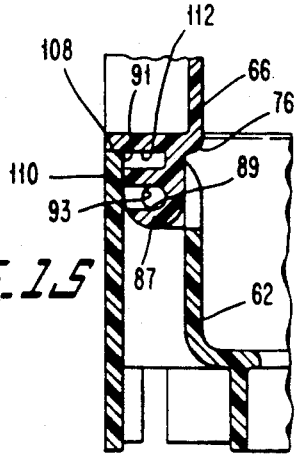
Fig. 15

303
303
370
378
360
128
364
128
341
341
341
341
372
100
100
362
122
122
342

374
370
366
360
200
200
200
200
364
132
132
376
372
384
100
100
118
362
382

FOLDING CRATE FOR HOLDING PACKAGES

This is a continuation-in-part of U.S. application Ser. No. 369,848 filed June 22, 1989.

BACKGROUND OF THE INVENTION

The present invention relates to a crate for holding packages. More particularly, the present invention relates to a foldable crate for holding packages, especially gable-top type packages.

Typically, packages that contain various products such as, for example, liquids, are transported by placing the packages in a shipping crate. Often times, the crates are dimensioned to receive and hold a plurality of packages. In that way, numerous packages can be more easily shipped at the same time.

The crates in which the packages are to be placed are usually manufactured as a one piece rigid unit. However, that type of construction presents several drawbacks. First, before the packages are placed in the crate for shipment to the distributors, the crates must be stored in some area of the packaging facility. Since the rigid construction of the crates prevents the crates from being reduced in size (i.e., folded), a large area is required for storing the crates. From a manufacturing standpoint, it may not be cost effective to utilize a large portion of the packaging plant for storing the empty crates.

A second disadvantage associated with crates that possess a rigid construction is that after the packages have been removed from the crates, the empty crates must be transported back to the distributor or to the packaging plant. Once again, since the size of the crates cannot be reduced, a large amount of space is required to transport the empty crates. As mentioned, that waste of space is not very cost efficient.

U.S. Pat. No. 3,841,477 addresses the aforementioned problems. That patent discloses an outer container for holding a plurality of packages in a close, tightly packed arrangement for transport or the like. The container is manufactured from a piece of rigid plastic material and includes a base portion and two sides that are connected to the base portion by hinge members. When packages are located in the container, the sides are positioned upright so that the sides and the base portion form a U-shaped member. A strap encircles the container and the packages located in the container. The hinges that connect the sides to the base member permit the sides to be folded outward so that when the container is not being used to hold packages, the container can be unfolded to a flat configuration.

Although that container does provide certain useful advantages over other prior art apparatus, the container is susceptible to certain improvements. For example, the construction of the container is such that when packages are positioned in the container, the containers cannot be stacked on top of one another in a stable manner because the tops of the packages extend above the edges of the sides of the container. When one container is stacked on top of another container, the containers rest on the upper surfaces of the packages positioned in the underlying container. As a consequence, the containers are able to slide relative to the underlying containers. The inability of the containers to be stacked on top of one another in a stable manner becomes an even greater problem when packages having non-planar tops, for example, gable-top type packages are positioned in the containers.

The aforementioned container also suffers from certain drawbacks with respect to the manner in which the container is folded. Although the aforementioned container is capable of being unfolded in a flat condition, the sides of the container are not adapted to be folded inwardly. Thus, that container is not capable of being folded into a more compact form.

Also, when the sides of the container are folded outwardly so that the container is laid out in a flat configuration., the container cannot be readily stacked on top of another container and aligned therewith to form a stable stack of flat folded containers.

The aforementioned container also is not designed to carry loads such as those produced when packages are placed in the container and the package-filled container is stacked on top of another package-filled container. As noted above, the containers are designed so that the packages in the container extend above the top edges of the sides of the container. Thus, when one package-filled container is stacked on top of another package-filled container, the load produced by the stacked containers must be supported by the packages and the packages may not be designed to support such loads.

OBJECTS AND SUMMARY OF THE INVENTION

In light of the above-described improvements to which the prior art containers for holding packages are susceptible, it is an object of the present invention to provide a crate for holding packages that is adapted to be folded in order to permit the crate to be stored in a smaller space when not in use.

Another object of the present invention is to provide a foldable crate that permits the crate to be easily aligned and stacked when the crate is filled with packages in order to result in a stable stack of crates.

A further object of the present invention is to provide a foldable crate that is constructed so as to permit the folded crate to be easily stacked and aligned on top of another crate in order to result in a stable stack of folded crates.

An additional object of the present invention is to provide a foldable crate that is adapted to support the loads produced by the stacking of package-filled crates.

Another object of the present invention is to provide a folding crate that can accommodate gable-top type packages, while permitting the crates to be stably stacked on top of one another.

These objects, as well as other additional objects that will become apparent from the following description, are achieved through a folding crate according to the present invention. The folding crate in accordance with the present invention includes a bottom member having a planar support surface upon which a plurality of packages are adapted to be placed, a first side wall and a second side wall. A first hinge arrangement hingedly connects the first side wall to the bottom member for permitting the first side wall to be folded toward the bottom member about a hinge axis. A second hinge arrangement hingedly connects the second side wall to the bottom member for permitting the second side wall to be folded toward the bottom member about a hinge axis. The hinge axis about which the first hinge arrangement pivots lies in a plane parallel to the support surface that is spaced from the plane parallel to the support surface about which the second hinge arrangement pivots.

In another aspect of the present invention, an arrangement that forms a part of the bottom member and the first side wall is provided for inhibiting the first side wall from being folded outwardly beyond a substantially vertical position with respect to the bottom. An arrangement that forms a part of the bottom member and the second side wall is also provided for inhibiting the first side wall from being folded outwardly beyond a substantially vertical position with respect to the bottom.

BRIEF DESCRIPTION OF THE DRAWINGS

Preferred embodiments of the present invention will be described in greater detail with reference to the accompanying drawings, wherein like elements bear like reference numerals and wherein:

FIG. 11 is an exploded cross-sectional front view of a portion of the folding crate according to the second embodiment of the present invention showing the manner in which the side walls are inserted into the bottom of the crate;

FIG. 12 is a cross-sectional view along the sectional line 12—12 in FIG. 11;

FIG. 13 is a cross-sectional view along the sectional line 13—13 in FIG. 11;

FIG. 14 is an exploded cross-sectional right side view of a portion of the folding crate according to the second embodiment of the present invention showing the manner in which the side wall is positioned in the bottom of the crate;

FIG. 15 is a cross-sectional right side view of a portion of the folding crate according to the second embodiment of the present invention showing the manner in which the side wall is hingedly connected to the bottom of the crate;

DETAILED DESCRIPTION OF THE PREFERRED EMBODIMENTS

Figure 1:
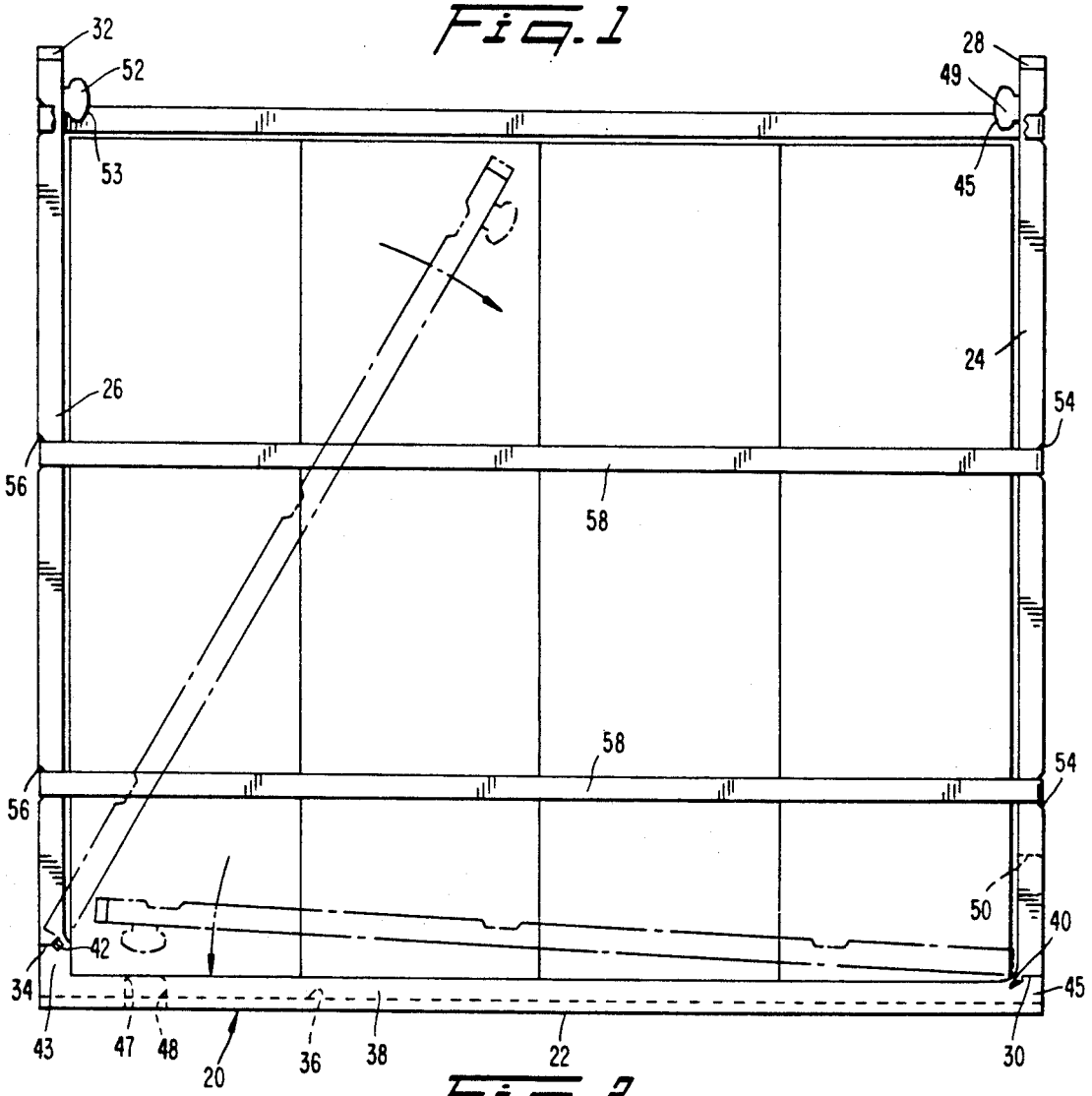
FIG. 1 is a side view of the folding crate according to one embodiment of the present invention showing the side walls in the vertically upright position and showing, in phantom, the side walls in a partially folded position.

Referring initially to FIG. 1, the folding crate 20 according to a first embodiment of the present invention includes a bottom 22, a first side wall 24 and a second side wall 26. The first side wall 24 has a first end 28 and a second end 30 while the second side wall 26 has a first end 32 and a second end 34. The bottom 22 has a planar support surface 36 upon which a plurality of packages are to be positioned for transportation in the crate 20. The planar support surface 36 is slightly recessed so that a raised border 38 surrounds the support surface. The raised border 38 helps to prevent the packages that are placed on the support surface 36 from sliding laterally. Thus, the group of packages placed on the support surface 36 are more securely positioned with respect to the bottom 22.

The folding crate 20 includes a first arrangement for hingedly connecting the first side wall 24 to the bottom 22 and a second arrangement 42 for hingedly connecting the second side wall 26 to the bottom 22. The first arrangement for hingedly connecting the first side wall 24 to the bottom 22 includes a strip of material 40 that unitarily and integrally connects the second end 30 of the first side wall 24 to one side of the bottom 22. The strip of material 40 is homogeneous with respect to the material from which the bottom 22 and the first side wall 24 are manufactured. The first hinge arrangement defined by the strip of material 40 constitutes what is termed a "living hinge".

Figure 3:
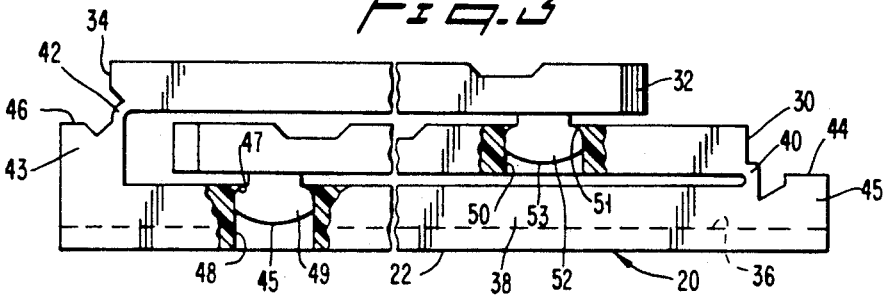
FIG. 3 is an enlarged side view of the folding crate according to the first embodiment of the present invention showing the manner in which the side walls are locked in the folded position.

As shown in more detail in FIG. 3 the second arrangement for hingedly connecting the second side wall 26 to the bottom member 22 includes a strip of material 42 that connects the second end of the second side wall 26 to a side of the bottom member 22 that is positioned opposite to the side of the bottom member 22 to which the first side wall 2 is attached. The strip of material 42 is homogeneous with respect to the material from which the second side wall 26 and the bottom 22 are manufactured. The second arrangement defined by the strip of material 42 constitutes what is termed a "living hinge".

Referring again to FIG. 1, the living hinges 40, 42 permit the first and second side walls 24, 26 to be positioned upright in a substantially vertical position while at the same time, permitting the first and second side walls 24, 26 to be folded inwardly toward the bottom member 22 as shown in phantom in FIG. 1. The hinge 40 lies in a plane that is parallel to the plane of the support surface 36 and the hinge 42 lies in a plane that is parallel to the plane in which the support surface 36 lies. The plane in which the hinge 40 lies is not coplanar with the plane in which the hinge 42 lies. Instead, the plane in which the hinge 40 lies is spaced from the plane in which the hinge 42 lies. That relationship can be more easily seen in the enlarged view of FIG. 3.

As a result of that arrangement of the hinges 40, 42, in order for the first ends 28, 32 of the first and second side walls 24, 26 to be positioned at the same height, it is necessary that the first side wall 24 be longer than the second side wall 26. The differences in length between the first side wall 24 and second side wall 26 is equal to the vertical distance between the horizontal planes in which the first and second hinges 40, 42 lie. In other words, the hinge axis about which the first hinge means 40 pivots lies in a plane parallel to the planar support surface 36 that is spaced from the plane parallel to the planar support surface 36 in which lies the hinge axis about which the second hinge means 42 pivots.

As can be seen from FIG. 1, the side of the bottom 22 to which the first side wall 24 is attached is shorter than the side of the bottom 22 to which the second side wall 26 is attached. That difference in height accounts for the vertical spacing between the hinge axis about which the first side wall 24 pivots and the hinge axis about which the second side wall 26 pivots.

The first embodiment of the folding crate according to the present invention also includes a first arrangement for permitting the first side wall 24 to be locked in the folded position and a second arrangement for permitting the second side wall 26 to be locked in the folded position. The first arrangement for permitting the first side wall to be locked in the folded position includes an aperture 48 that is located in the bottom 22. The aperture 48 extends through the bottom 22 and is located adjacent the side of the bottom 22 to which the second side wall 26 is attached. The first arrangement also includes a projection 49 that is attached to and extends away from the inner face of the first side wall 24. The projection 49 is positioned adjacent the free end of the first side wall 24 or, in other words, adjacent the second end 28 of the first side wall 24.

Figure 2:
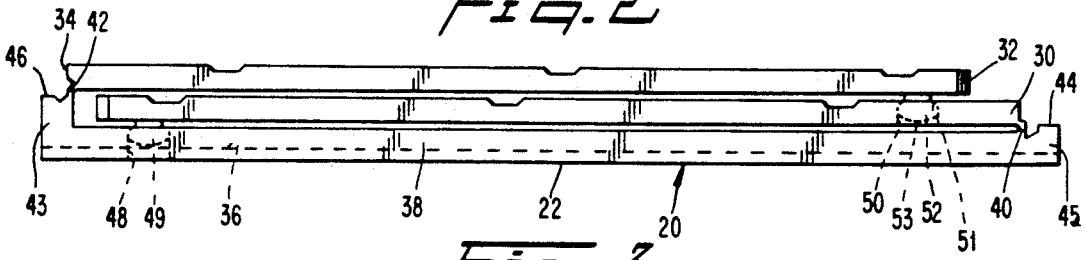
FIG. 2 is a side view of the folding crate according to the first embodiment of the present invention showing the side walls folded completely inwardly.

As shown in FIG. 2, the projection 49 and the aperture 48 are positioned such that when the first side wall 24 is folded inwardly toward the bottom 22, the projection 49 can be positioned in the aperture 48. In that way, the first side wall 24 can be locked in the folded position.

In order to further help lock the first side wall 24 in the folded position, the aperture 48 has a radially inwardly extending lip 47 that overlies the projection 49 when the projection is positioned in the aperture 48. Further, the projection 49 includes an enlarged head portion 45 so that the projection is somewhat mushroom-shaped. The enlarged head portion is positioned under the lip 47 when the projection is located in the aperture 48. The lip 47 helps to ensure that the projection 49 will remain in place in the aperture 48 so that the first side wall 24 will remain in the locked position. The radially inwardly extending lip 47 can be more clearly seen in the exploded view of FIG. 3.

The second arrangement for locking the second side wall 26 in the folded position includes an aperture 50 that is positioned in the first side wall 24. The aperture 50 extends through the first side wall 24 and is positioned adjacent the second end 30 of the first side wall 24. The aperture 50 includes a radially inwardly extending lip 51. The second arrangement also includes a projection 52 that is attached to the inner face of the second side wall 26. The projection extends away from the inner face of the second side wall 26 and is located adjacent the first end 32 of the second side wall 26. The projection 52 includes an enlarged head portion 53 so that the projection 52 is somewhat mushroom-shaped.

The projection 52 and the aperture 50 are positioned such that when the second side wall 26 is folded inwardly toward the bottom 22, the projection 52 is positioned in the aperture 50. Further, the enlarged head portion 53 of the projection 52, as seen in FIG. 3, is positioned under the radially inwardly extending lip 51 of the aperture 50 in order to more securely lock the second side wall 26 in the folded position.

As is evident from FIG. 2, in order to fold the first and second side walls 24, 26, inwardly toward the bottom 22, the first side wall 24 is folded inwardly before the second side wall 26. After the first and second side walls 24, 26 have been folded inwardly and locked in the folded position as a result of the above-described first and second arrangements, the first and second side walls 24, 26 are substantially parallel to one another and to the planar support surface 36.

Although the aforementioned apertures 48, 50 have been described as extending completely through the bottom 22 and first side wall 24 respectively, it is to be understood that the apertures 48, 50 could be configured such that they extend only partially through the bottom 22 and first side wall 24 respectively. It is only necessary that the apertures 40, 50 be configured so that the projections 49, 52 can be positioned therein for locking the first and second side walls 24, 26 in the folded position.

The first embodiment of the folding crate according to the present invention further includes an arrangement forming a portion of the bottom 22 and the first and second side walls 24, 26 for inhibiting the first and second side walls 24, 26 from folding outwardly beyond a substantially vertical position with respect to the bottom 22. The arrangement for inhibiting the first side wall 24 from folding outwardly beyond a substantially vertical position includes the end surface at the second end 30 of the first side wall 24 contacting the upper surface 44 of an upstanding side 45 of the bottom 22 when the first side wall 24 is positioned in a substantially vertical manner with respect to the bottom 27. Similarly, the arrangement for inhibiting the second side wall 26 from folding outwardly beyond a substantially vertical position includes the end face at the second end 34 of the second side wall 26 contacting the upper surface 46 of an upstanding side 43 of the bottom 22 when the second side wall is positioned in a substantially vertical position with respect to the bottom 22.

Although the above-described arrangements serve to inhibit the first and second side walls 24, 26 from folding outwardly beyond a substantially vertical position, the bottom 22 and the first and second side walls 24, 26 could be configured such that the first and second side walls 24, 26 are able to move slightly outwardly beyond the vertically upright position before the end faces of the first and second side walls 24, 26 contact and rest against the upper surfaces 44, 46 of the upstanding sides 45, 53 respectively of the bottom 22. The main objective is to prevent the first and second side walls 24, 26 from being folded completely outwardly so that the bottom 22 and the side walls 24, 26 are flat.

At least one and preferably two grooves 54 are located in the outer face of the first side wall 24. Likewise, at least one and preferably two grooves 56 are located in the outer face of the second side wall 26. Each of the grooves 54 in the first side wall 24 is horizontally aligned with one of the grooves 56 in the outer face of the second side wall 26. In that way, a strap 58 can be positioned in the aligned grooves 54, 46 to thereby encircle the crate 20 when packages are positioned in the crate 20. The straps 58 help to keep the packages in place in the crate 20 and help provide a stable arrangement of the packages.

It is evident from the above description that numerous advantages can be achieved through use of a folding crate that is constructed according to the first embodiment of the present invention. Since the crate according to the first embodiment of the present invention is foldable, less space is required for storing the crates when they are not being used for holding packages. Further, the manner in which the crate is folded permits the crate size to be reduced to an extent that would not be possible if the side walls were folded outwardly. The type of hinge that is employed for hingedly connecting the side walls to the bottom is simple and can be easily formed at the same time as the rest of the crate. Additionally, the locking arrangements for locking the side walls in the folded configuration are desirable because they help ensure that the crates will remain folded even if the crates are roughly handled.

Figure 4:
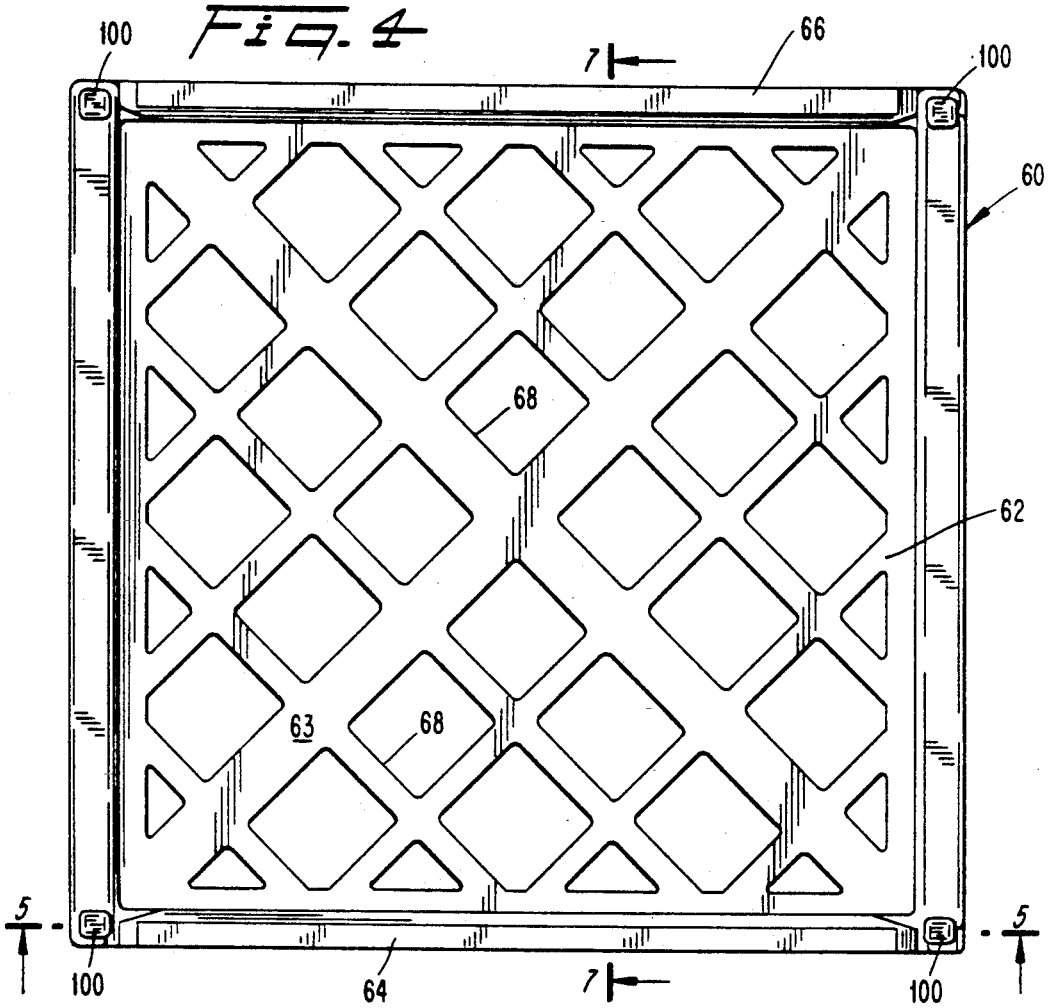
FIG. 4 is a top view of a folding crate according to a second embodiment of the present invention showing the side walls in a vertically upright position.

A second embodiment of the folding crate according to the present invention will now be described with reference to FIGS. 4-16 The folding crate 60 according to a second embodiment of the present invention includes, as seen in FIG. 4, a bottom member 62, a first side wall 64 and a second side wall 66. The bottom member 62 is manufactured to have a plurality of openings 68 that extend therethrough in order to make the bottom member 62 lighter in weight and cheaper to manufacture as a result of reduced material costs. The bottom member 62 has a planar support surface 63 upon which a plurality of packages are to be placed.

Figure 7:
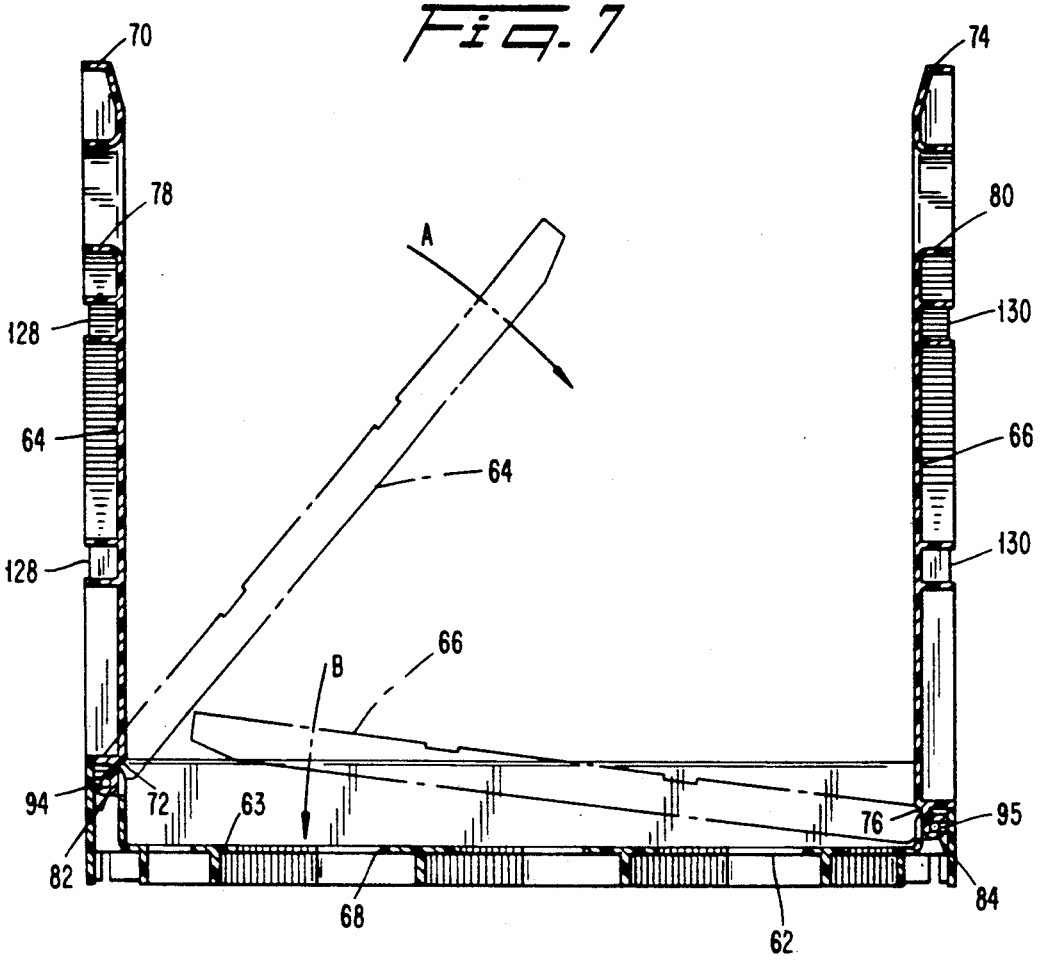
FIG. 7 is a cross-sectional view of the folding crate according to the second embodiment of the present invention along the sectional line 7—7 in FIG. 4.

Turning to FIG. 7, the first side wall 64 has a first end 70 and a second end 72. Similarly, the second side wall 66 has a first end 74 and a second end 76. Each of the first and second side walls 64, 66 has a ribbed outer surface and a planar inner surface. The planar inner surface permits the packages that are positioned inside the crate 60 to be placed flush up against the inner surface of the first and second side walls 64, 66. The ribbed outer surface of each of the side walls 64, 66 results in light weight construction and reduced material costs.

The first side wall 64 has a handle opening 78 that extends completely therethrough adjacent the first end 70. Likewise, the second side wall 66 has a handle opening 80 that extends completely therethrough adjacent the first end 74. The handle openings 78, 80 are positioned at substantially the same distant from the respective first ends 70, 74 so that the handle openings 78, 80 are in substantial horizontal alignment. The handle openings 78, 80 serve as handles for lifting the crate when the side walls 64, 66 are positioned vertically upright.

Figure 5:
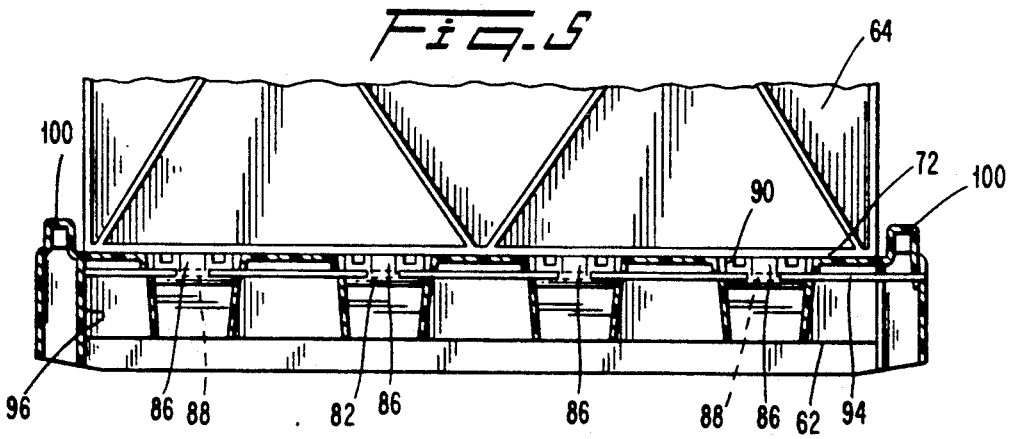
FIG. 5 is cross-sectional view of a portion of the folding crate according to the second embodiment of the present invention along the sectional line 5—5 in FIG. 4.
Figure 6:
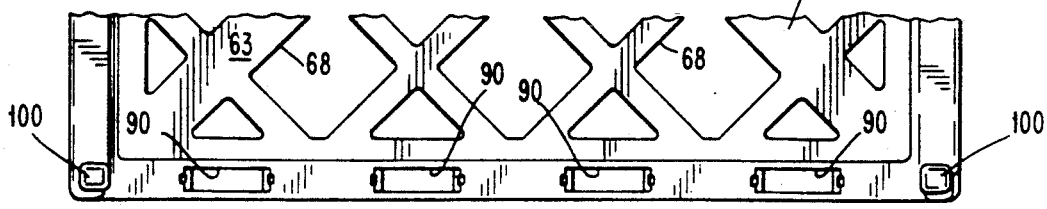
FIG. 6 is a top view of a portion of the folding crate according to the second embodiment of the present invention showing the bottom of the crate without the side walls attached.

The first side wall 64 is connected to the bottom 62 by way of a first hinge arrangement 82 while the second side wall 66 is connected to the bottom 62 by way of a second hinge arrangement 84. Turning initially to FIG. 5, the details of the first and second hinge arrangements 82, 84 will be described.

The first hinge arrangement 82 includes a plurality of knuckles 86 that extend from the second end 72 of the first side wall 64. Each of the knuckles 82 has a longitudinally extending hole 88 that defines a hollow knuckle. The features of the first hinge means 82 are shown more clearly in the exploded view of FIG. 11. In FIG. 11, one of the knuckles 86 and the hole 88 that extends longitudinally therethrough are clearly shown.

The first hinge means 82 further includes a plurality of spaced apart openings 90 positioned along one side of the bottom 62. The arrangement of the spaced apart openings 90 can be more clearly seen in FIG. 6. The openings 90 are spaced apart the same distance that the knuckles 86 are spaced apart. In that way, each one of the knuckles 86 can be fitted into one of the openings 90.

Referring back to FIG. 11, the first hinge arrangement 82 further includes a longitudinal hole 92 that extends along a substantial portion of a length of on ® side of the bottom 62. Additionally, the first hinge arrangement 82 includes a pin 94 that extends through the longitudinally extending hole 92 in the side of the bottom and through the openings 88 in the knuckles 86 that extend from the second end 72 of the first side wall 64. The longitudinally extending hole 92 is open to the exterior of the crate at one side face of the crate, as seen in FIG. 11, so that the pin 94 can be properly inserted through the longitudinally extending hole 92 and through the holes 88 in the knuckles 86 after the knuckles 86 have been positioned in openings 90. However, the longitudinally extending hole 92 does not extend completely through the side of the bottom 62. Rather, the longitudinally extending hole 92 extends only so far as to permit the pin 94 to be inserted through the aligned openings 88, 92 and abut against the wall 96. In that way, the pin 94 is completely housed within the side of the crate.

As seen in more detail in FIGS. 12 and 13, the holes 88 the extend through the knuckles 86 open to the inner side of the first side wall 64 by way of the slotted opening 96. Similarly, the longitudinally extending hole 88 opens to the outer side of the first side wall 64 through two slotted openings 98.

As seen in FIG. 14, the first side wall 64 is inserted into the bottom 62 by first aligning each one of the knuckles 86 with one of the openings 90 in the side of the bottom 62. The first side wall 64 is then lowered toward the bottom 62 so that the knuckles 86 are positioned in the openings 90 and so that the longitudinally extending openings 88 in the knuckles 86 are in alignment with the longitudinally extending opening 92 in the side of the bottom 62. The pin 94, as seen in FIG. 11, is then inserted through the aligned openings 88 and 92. It should be understood from the foregoing that the second side wall 66 is substantially identical to the first side wall 64 and thus, detailed drawings of the second side wall and the knuckles that extend therefrom are not included. However, in FIG. 15, a second side wall 66 is shown after it has been inserted into the bottom 62. Knuckles 87 extending from the second end 76 of the second side wall 66 are positioned in openings 91 in a side of the bottom 62 that is positioned opposite to the side to which the first side wall 64 is hingedly connected. Holes 89 that extend longitudinally through the knuckles 87 are aligned with a longitudinally extending hole 93 that extends through the opposite side of the bottom 62. As in the case of the first side wall 64, a pin 95 is positioned so that it passes through the aligned holes 89 in the knuckles 87 and the longitudinally extending hole 93 in the opposite side of the bottom 62.

The above-described construction of the bottom 62 and the first and second side walls 64, 66 and the manner in which the first and second side walls 64, 66 are connected to the bottom 62 is advantageous because it permits the first and second side walls 64, 66 to be folded inwardly in order to produce a compact folded crate when the crate is not in use. As shown in full line configuration in FIG. 7, the first side wall 64 and the second side wall 66 can be positioned in a substantially vertical position for receiving packages. After the packages have been removed, the first side wall 64 can be folded inwardly as shown in phantom in FIG. 7 in the direction of arrow A. Similarly, after first side wall 64 has been folded inwardly, the second side wall 66 can be folded inwardly in the direction of arrow B as shown in phantom in FIG. 7. The resulting folded configuration of the crate is depicted in FIG. 8.

Figure 8:
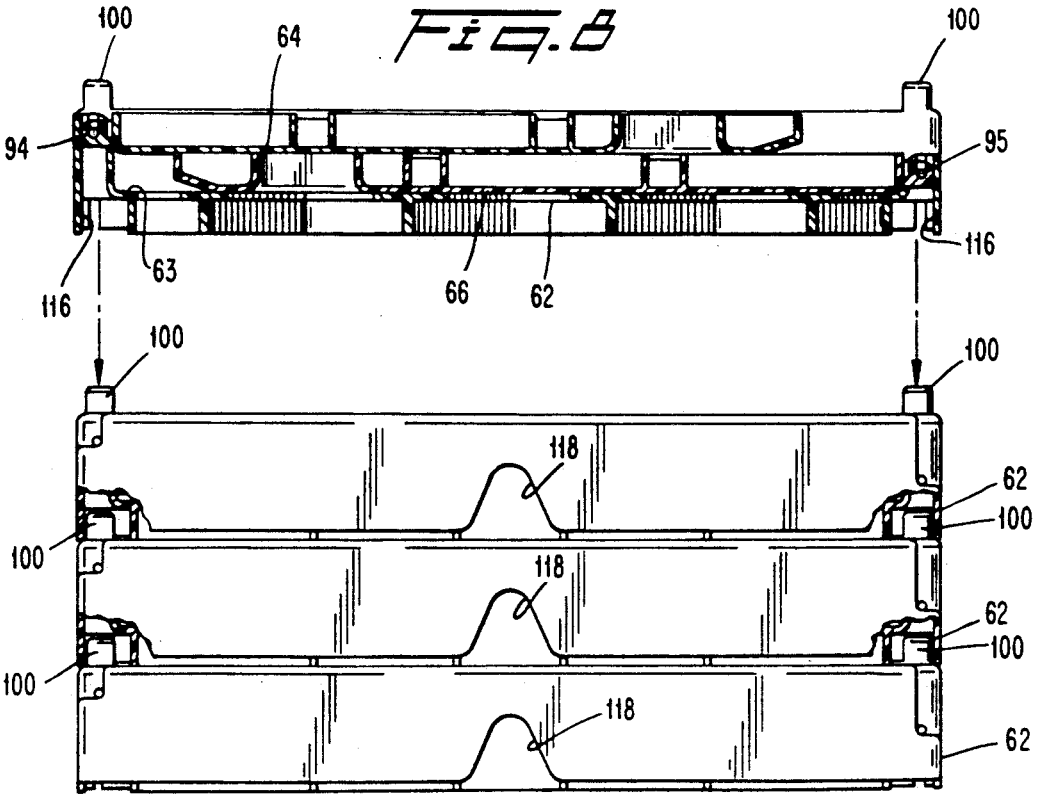
FIG. 8 is a partial cross-sectional right side view of a plurality of folding crates according to the second embodiment of the present invention showing the crates in a folded and stacked arrangement.

The first and second hinge arrangements 82, 84 are positioned such that in the folded configuration, the first and second side walls 64, 66 can lie substantially horizontal and can be positioned substantially parallel to each other and to the support surface 63 as illustrated in FIG. 8. The first and second side walls, 64, 66 are capable of being positioned in that matter when folded because the hinge axis about which the first side wall 64 pivots or folds is at an elevationally different position than the hinge axis about which the second side wall 66 pivots or folds. Stated differently, the hinge axis of the first hinge arrangement 82 lies in a plane parallel to the planar support surface 63 that is spaced from the plane parallel to the planar support surface 63 in which the hinge axis of the second hinge arrangement 84 lies. Generally speaking, the vertical distance between the hinge axes about which the first and second side walls 64, 66 pivot or fold as measured in a direction perpendicular to the planar support surface 63 is approximately equal to the thickness of the first side wall 64.

The construction of the first and second side walls 64, 66, the first and second hinge arrangements 82, 84 and the bottom 62 is such that the first and second side walls 64, 66 are inhibited from being folded outwardly beyond a substantially vertical position relative to the horizontally positioned bottom 62. The particular construction that permits such an inhibition of movement can be seen more clearly from FIGS. 14 and 15. Turning first to FIG. 14, each of the side walls 64, 66 has an end face from which the knuckles extend. In the case of the first side wall 64 shown in FIG. 14, the knuckle 86 is shown as extending from an end face 102. The bottom 62 has an upstanding wall 104 that extends upwardly beyond the planar support surface 63. The upstanding wall 104 also has an upper surface 106. When the first side wall 64 is inserted into the bottom 62 so that the knuckles 86 are positioned in the openings 90, the end face 102 of the first side wall 64 contacts and rests against the upper surface 106 of the upstanding wall 104. Similarly, as seen in FIG. 15 which shows the second side wall 66 hingedly connected to the bottom 62, the upper surface 108 of the upstanding wall 110 and the end face 112 of the second side wall 66 abut against one another. Because the end faces 102, 112 of the first and second side walls 64, 66 rest against the upper surfaces 106, 108 of the upstanding walls 104, 110, the first and second side walls 64, 66 cannot fold outwardly away from each other.

It is to be understood from the above description that construction of the crate does permit the first and second side walls 64, 66 to fold slightly outwardly beyond the vertical position. That slight outward movement permits a loading assembly to be inserted between the first and second side walls 64, 66 in order to urge the first and second side walls 64, 66 outwardly beyond the vertical position prior to placing the packages in the crate. The ability of the loading assembly to urge the first and second side walls 64, 66 outwardly prior to inserting the packages into the crate permits the packages to be more easily inserted into the crate. Accordingly, it is desirable that the crate be constructed such that the first and second side walls 64, 66 are able to move slightly outwardly beyond the vertically upright position before the end faces 102, 112 of the first and second side walls 64, 66 come in contact with and rest against the upper surfaces 104, 108 of the upstanding walls 104, 110.

Figure 16:
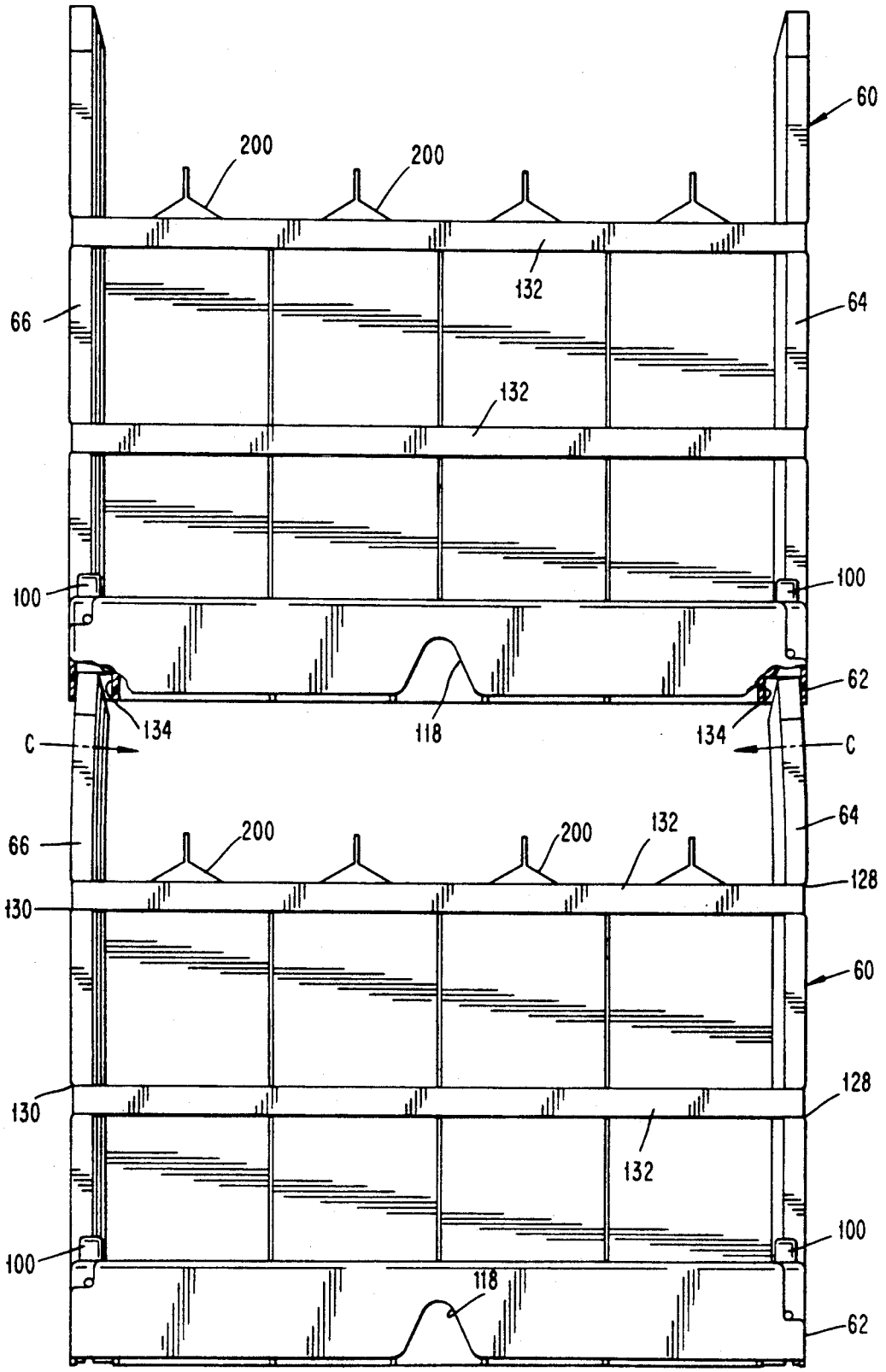
FIG. 16 is a partial cross-sectional left side view of two stacked folding crates according to the second embodiment of the present invention.

Another function associated with the construction of the side walls 64, 66 and the bottom 62 as described above is that such construction helps support the load that develops when the crates are filled with packages and are then stacked on top of one another. Referring first to FIG. 16, two crates 60 are shown in a stacked configuration. It is readily apparent that when packages 200 are placed in the crates 60, the weight of the crates 60 is significantly increased. Depending upon the contents of the crates, the increase in weight can be quite significant. When the crates 60 are stacked on top of one another, the load (i.e., the weight of the crates and the packages) is transmitted through the first and second side walls 64, 66. As shown in FIG. 11, the contact that occurs between the end faces 102, 112 of the first and second side walls 64, 66 and the upper surfaces 106, 108 of the upstanding walls 104, 110 (FIGS. 15 and 16) helps distribute the load which is transmitted through the first and second side walls 64, 66. Further, the upper surfaces 106, 108 of the upstanding side walls 104, 110 serve to support a portion of the load produced by stacking package filled crates.

The load (i.e., the weight of the crates and the packages) that is transmitted through the first and second side walls 64, 66 is also distributed to other areas of the bottom 62 as a result of the manner in which the pins 94, 95 are arranged with respect to the bottom 62. Turning to FIG. 11, it can be seen that, in the case of the first side wall 64, once the first side wall 64 is positioned on the bottom 62 so that the knuckles 86 extend through the openings 90 to the side of the bottom and the pin 94 is properly inserted through the aligned longitudinally extending hole 92 and the holes 88 in the knuckles 86, the pin 94 will rest on surfaces 114. Further, the knuckles 86 will rest on and be supported by the pin 84. Consequently, the load that is transmitted through the first and second side walls 64, 66 will be distributed to the sides of the bottom through the surfaces 114 upon which the pins 84 rest. It is of course understood that the second side wall 66 and pin 95 arrangement are configured in substantially the same manner as that noted above and thus, that arrangement also serves to transmit and distribute the load produced by stacked crates that contain packages.

Another advantage associated with the folding crate according to the second embodiment of the present invention is that an arrangement is provided on the folding crate to facilitate stacking of the crates and orientation of the crates with respect to one another when the crates are in the folded configuration. That arrangement includes, as seen in FIG. 8, a plurality of projections 100 that extend upwardly from the sides of the bottom 62. As can be more clearly seen in FIG. 4, at least two and preferably four projections are provided, each of which extends upwardly from one of the corners of the bottom 62. The projections 100 are configured such that when the first and second side walls 64, 66 are folded inwardly and positioned substantially horizontally as illustrated in FIG. 8, the projections 100 extend upwardly a sufficient distance above the outer surface of the first side wall 64.

The bottom 62 of the crate also includes hollow portions 116 at the underside of the corners of the crate. The projections loop and the hollow underside portions 116 of the crate permit the crates to be easily stacked on top of one another and oriented with respect to one another when the first and second side walls 64, 66 are folded inwardly. In particular, it is to be noted that the projections 100 are set inwardly from the outer side face of the bottom 62 so that the projections 100 on one crate can fit into the hollow underside portions 116 of a crate positioned thereabove. The presence of the projections 100 permits the crates to be accurately aligned with respect to one another during stacking so as to produce a stack of crates that is stable.

Although the projections 100 are preferably located at the corners of the bottom 62, it can be readily seen that accurate alignment of the stacked crates can also be achieved if the projections 100 are positioned at places other than the corners of the bottom 62.

Figure 9:
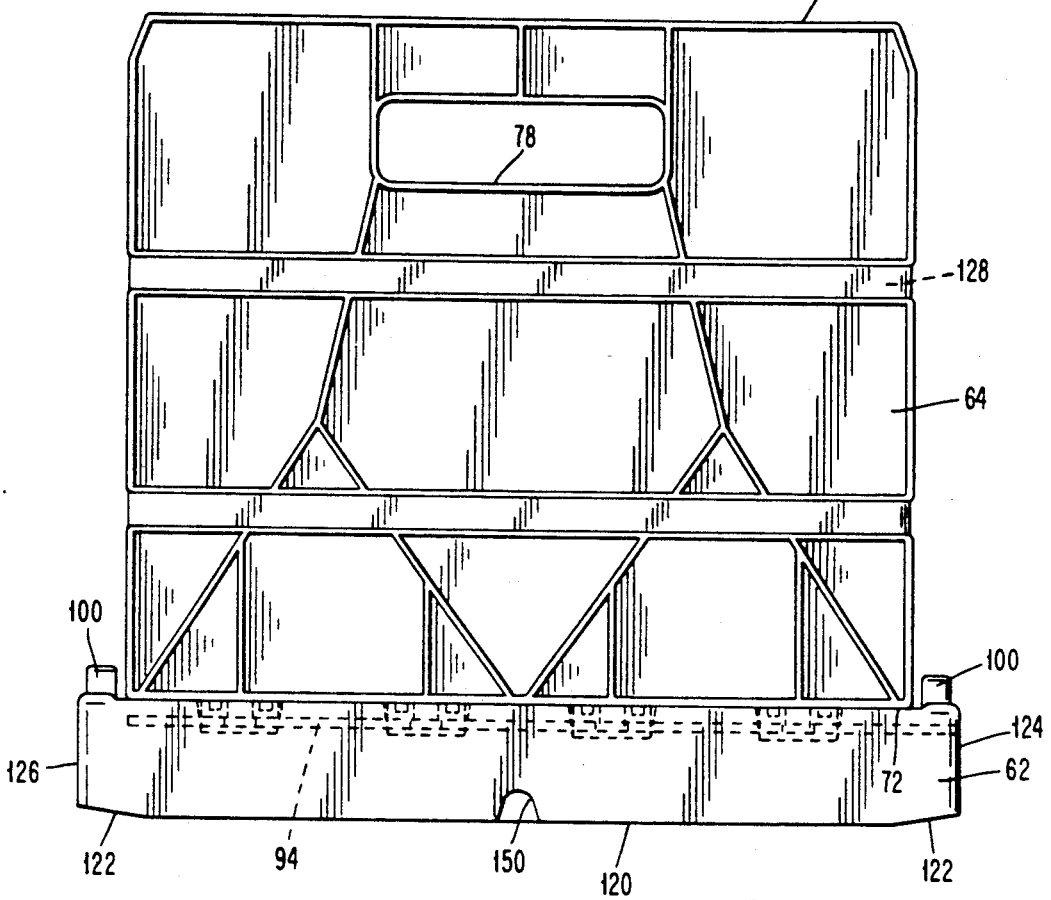
FIG. 9 is a front view of the folding crate according to the second embodiment of the present invention showing the side walls in a vertically upright position.

Depending upon the design tolerances of the crates as well as other factors, the crates may not be readily separable from one another when they are in the stacked condition illustrated in FIG. 8. In order to address that situation, the bottom 62 of the crate is provided with a hole 150 as seen in FIG. 9. In addition to the hole shown in FIG. 9, another substantially identical hole (not shown) is provided on the opposite side of the bottom 62. The holes 150 are located in the outer faces of the sides of the bottom 62 and each of the holes 150 opens to the underside surface of the bottom 62.

Each of the holes 150 is adapted to receive a pin that is preferably positioned in the holes 150 after the crates have been stacked. The pin permits the crates to be more easily separated by allowing a downward force to be directed against the bottom most crate while the remaining crates in the stack are lifted upward. That is, a machine can be employed to grab the pins located between the bottom two crates in order to apply a downward force against the bottom most crate while the other crates in the stack are being pulled upwardly.

Figure 10:
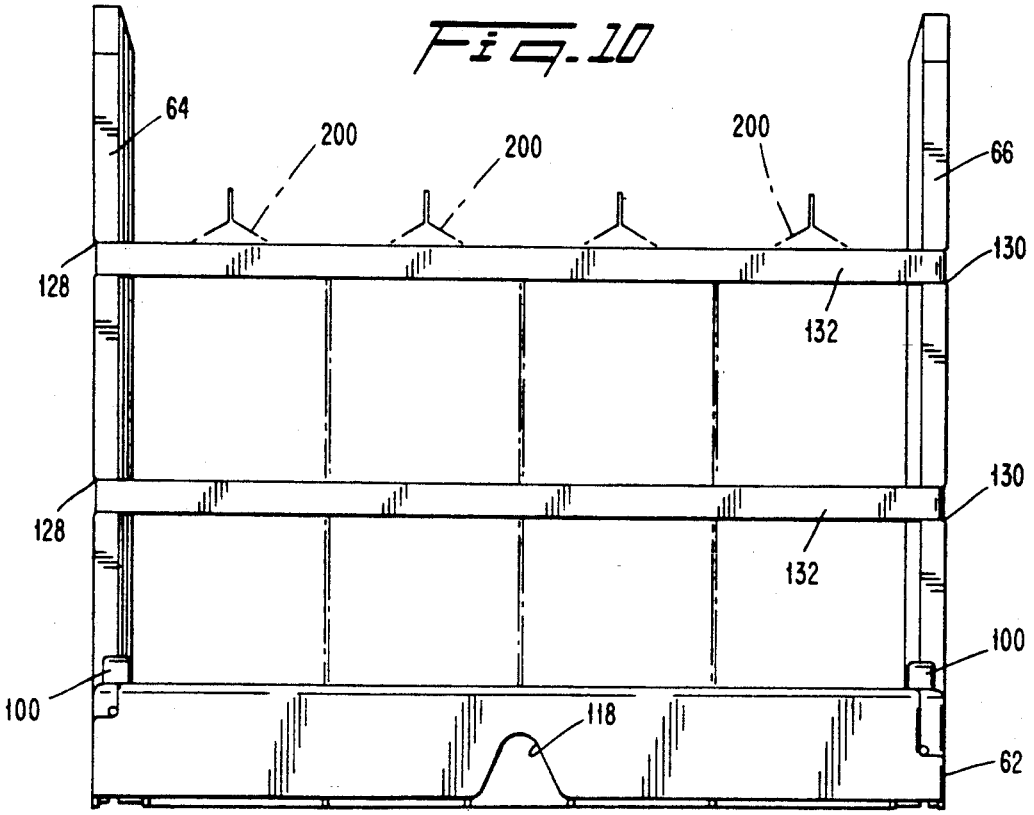
FIG. 10 is a right side view of the folding crate according to the second embodiment of the present invention showing gable-top type containers in the crate.

Referring to FIG. 10, a cut-out portion 118 is positioned in an outer side face of the bottom 62. Although not shown in the drawings, another cut-out portion is located in the outer side face of the bottom 62 located opposite to the cut-out 118 shown in FIG. 10. The cut-out portions 118 are located on those sides of the bottom 62 where the holes 150 are not located. The cut-out portions 118 open to the underside of the bottom 62. The cut-out portions 118 are configured in such a manner as to permit a dragging hook to be positioned therein for facilitating movement of a stack of crates across a floor. When packages 200 are positioned in the crates and the crates are in a stacked configuration on a floor, the stack of crates is very heavy and can be difficult to move from one place to another in a storage facility. Moreover, it is not efficient to continually unstack and restack the crates in order to move the crates. Accordingly, a dragging hook can be positioned in one of the cut-out portions 118 so as to permit the entire stack of crates to be dragged across the floor.

In order to further facilitate the movement of stacks of crates across the floor, the underside surface 120 of the bottom 62 includes inclined portions 122. The inclined portions 122 of the underside surface 120 extend along opposite sides of the bottom 62. Moreover, the inclined portions 122 of the underside surface 120 are positioned opposite to the cut-out portions 118. Thus, for instance, cut-out portion 118 would be positioned in outer side face surface 124 as seen in FIG. 9 while another cut-out portion would be positioned in outer side face surface 126 of the bottom 62. The inclined portions 122 facilitate movement of the crates when a stack of crates is dragged across the floor because the lower edges of the bottom 62 of the crate are raised off the surface of the floor. As a result, the bottom crate in a stack of crates can move across the floor surface much more readily and with less chance of becoming impeded in its movement.

The outer face of the first side wall, as illustrated in FIG. 10, includes at least one and preferably at least two grooves 128 that extend across the entire width thereof. Likewise, the second side wall 66 includes at least one and preferably at least two grooves 130 in the outer face thereof that extend across substantially the entire width of the second side wall 66. Each of the grooves 128 in the first side wall 64 are horizontally aligned with one of the grooves 130 in the second side wall 66. Straps 132 are positioned in the aligned grooves 128, 130 in the first and second side walls 64, 66. The straps 132 encircle the crate 60 when packages 200 are positioned in the crate 60 so that the packages 200 are securely held in place in the crate 60 and are prevented from falling out of the crate 60.

The second embodiment of the folding crate 60 according to the present invention is configured such that when packages 200 are positioned in the crate 60, the crates can be stacked on top of one another. As seen in FIG. 16, underside portions 134 of the bottom 62 that are positioned below the hinge connections are hollow. The hollow underside portions 134 extend along the portion of the sides of the bottom 62 to which the first and second side walls 64, 66 are hingedly connected. The hollow underside portions 134 are adapted to receive the upper ends of the first and second side walls 64, 66. As can be seen from FIG. 16, when one crate 60 is stacked on top of another crate, the first and second side walls 64, 66 must be bent slightly inwardly in the direction of arrows C so that the upper ends of the first and second side walls 64, 66 can be seated in the hollow underside portions 134. As an alternative, the upper ends of the first and second side walls 64, 66 could be narrowed in thickness so that the upper ends 64, 66 of the first and second side walls 64, 66 can be seated in the hollow underside portions without bending the side walls 64, 66 inwardly. The upper ends of the first and second side walls 64, 66 are preferably beveled so that the side walls 64, 66 can be more easily inserted into the hollow underside portions 134.

In order to permit the crates 60 to be stacked on top of one another in a level and stable manner, it is necessary that the upper ends of the first and second side walls, 64, 66 (i.e., the ends farthest from the bottom 22) be at the same height. In order to achieve that objective, the length of the first side wall 64 is shorter than the length of the second side wall 66. That difference in length between the first and second side walls 64, 66 takes into account the fact that the hinge axis about which the first side wall 64 pivots is positioned at a vertically higher position than the hinge axis about which the second side wall 66 pivots. Thus, the difference in length between the first and second side walls 64, 66 is substantially equal to the vertical distance between the hinge axis about which the first side wall 64 pivots and the hinge axis about which the second side wall 66 pivots.

Figure 18:
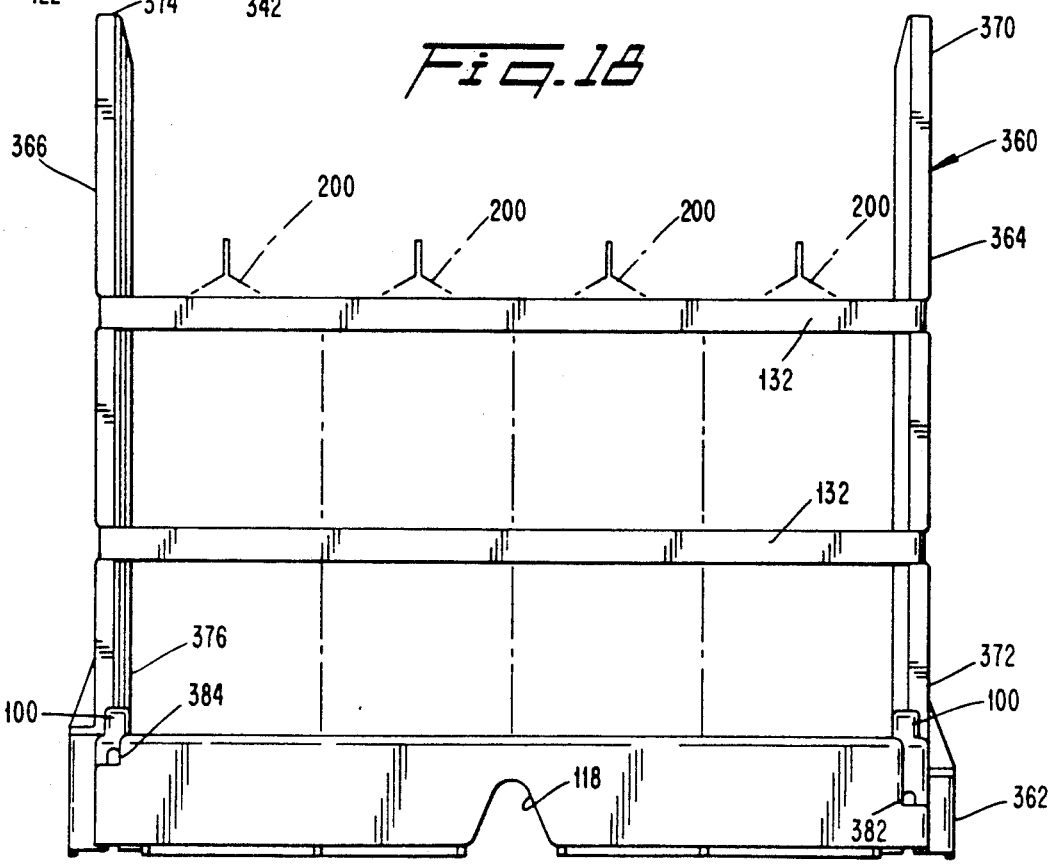
FIG. 18 is a right side view of the folding crate according to the third embodiment of the present invention showing gable-top type containers in the crate.
Figure 19:
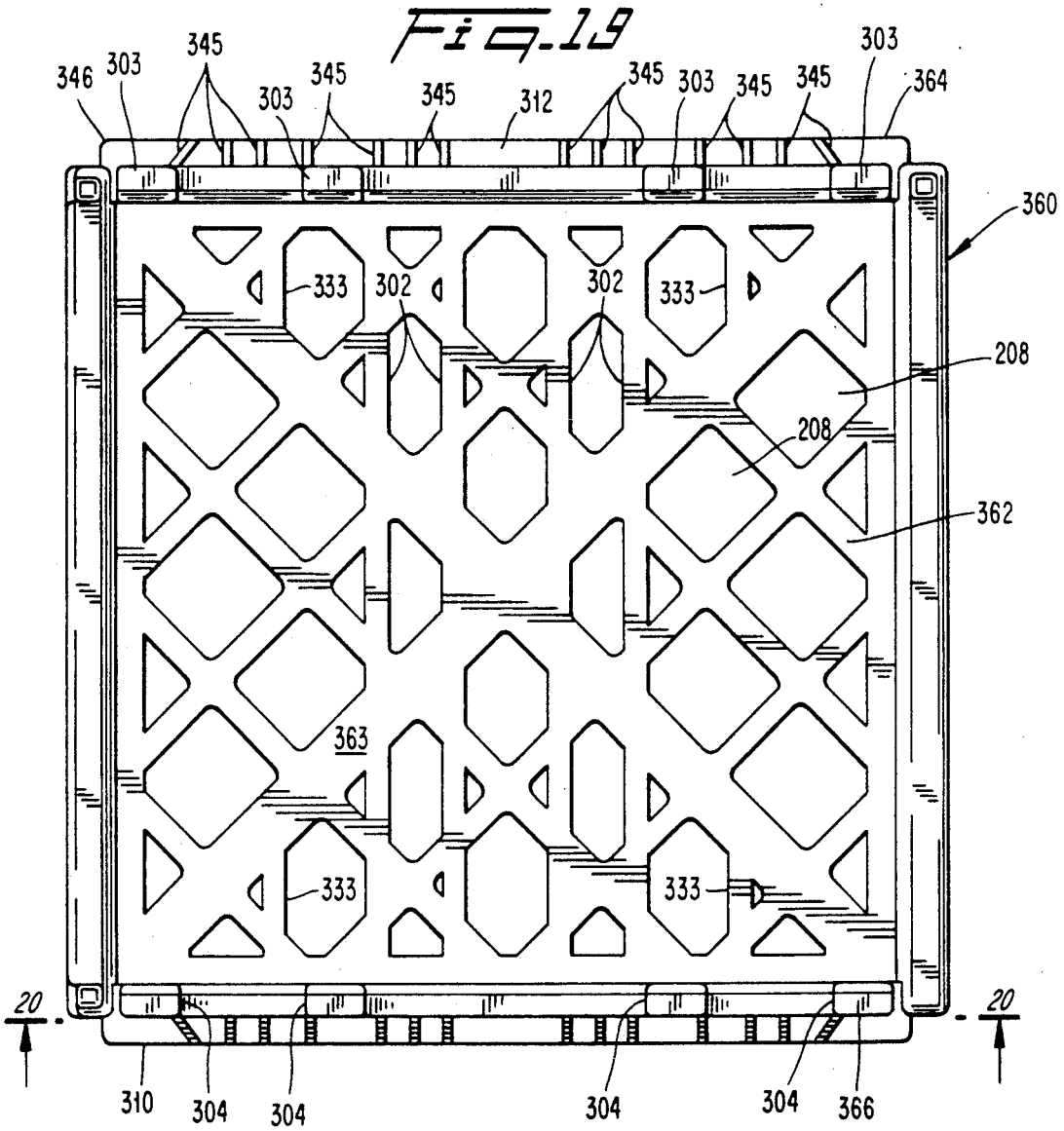
FIG. 19 is a top view of a folding crate according to a third embodiment of the present invention showing the side walls in a vertically upright position.

A third embodiment of the folding crate according to the present invention will now be described with reference to FIGS. 17-23 wherein a folding crate 360 invention includes a bottom member 362, a first side wall 364 and a second side wall 366. The bottom member 362 is formed to have a plurality of openings 368 that extend therethrough in order to make the bottom member 362 lighter in weight and less expensive to manufacture as a result of reduced material. The bottom member 362 has a planar support surface 363 upon which a plurality of packages are to be placed. As shown in FIG. 19, the bottom member 362 of the third embodiment also includes at least four reinforcement ribs 302 extending between the first and second side walls 364, 366 to provide added strength to the bottom member 362. Partial ribs 333 extending only a portion of the distance between the side walls may also be included to provide strength to the bottom member 362.

Referring to FIGS. !7 and 18, the first side wall 364 has a first end 370 and a second end 372. Along the edge of the first end 370 of the first side wall 364, are disposed at least four finger protrusions 303. Similarly, the second side wall 366 has a first end 374 and a second end 376 and positioned along the edge of the second end 376 are finger protrusions 304. The finger protrusions 303, 304 of each side wall 364, 366 aid the stacking capability of the crate of the third embodiment.

Figure 17:
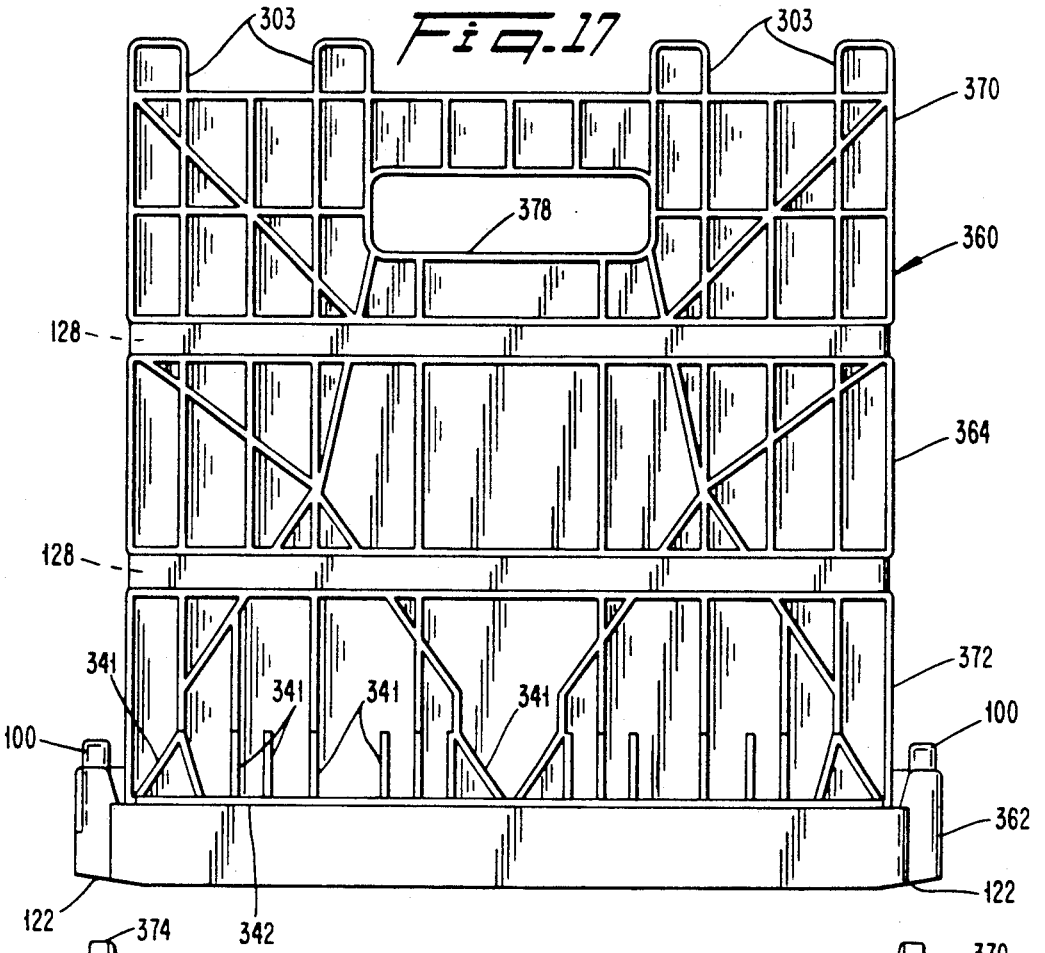
FIG. 17 is a front view of the folding crate according to the third embodiment of the present invention showing the side walls in a vertically upright position.

Referring to FIG. 17, each of the first and second side walls 364, 366, has a ribbed outer surface and a planar inner surface. However, the side walls 364, 366 of the third embodiment have more ribs than the side walls 64, 66 of the second embodiment in order to ensure sufficient strength and stability to each of the side walls. The planar inner surface of each of the side walls, as seen in FIG. 18, permits packages 200 that are positioned inside the crate 360 to be positioned flush against the inner surface of the first and second side walls 364, 366.

The first side wall 364 has a handle opening 378 that extends completely therethrough and is located near the first end 370 of the side wall 364. The second side wall 366 similarly has a handle opening (not shown) that extends completely therethrough and that is located near the first end 374 of the side wall 366. The handle openings on each of the sidewalls are positioned at substantially the same distance from the respective first ends 370, 374 so that the handle openings are in substantial horizontal alignment. The handle openings are useful for lifting the crate when the side walls 364, 366 are positioned vertically upright.

The first side wall 364 is connected to the bottom 362 at a first hinge arrangement 382, while the second side wall 366 is connected to the bottom 362 at a second hinge arrangement 384. The first and second hinge arrangements 382, 384 are substantially the same as the first and second hinge arrangements 82, 84 of the second embodiment of the present invention, respectively. Hence, in substantially the same manner as in the second embodiment, the first and second side walls 364, 366 of the third embodiment may be folded inwardly in order to produce a compact, folded crate when the crate is not in use as shown in FIG. 21.

Figure 21:
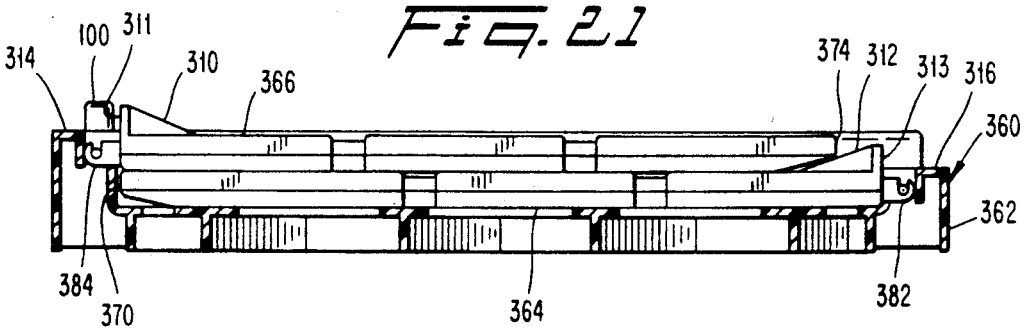
FIG. 21 is a partial cross-sectional right side view of the folding crate according to a third embodiment of the present invention showing the crate in a folded arrangement.
Figure 23:
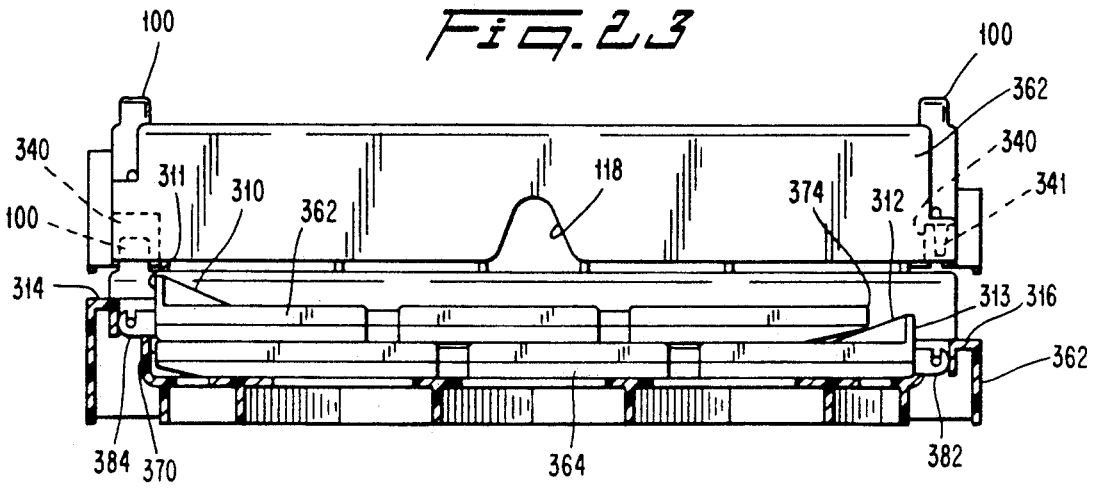
FIG. 23 is a partial cross-sectional view of the folding crate according to the third embodiment of the present invention showing two crates in a folded and stacked arrangement.

The first and second hinge arrangements 382, 384 are positioned such that, in the folded configuration, the first and second side walls 364, 366 are positioned substantially horizontal and can be positioned substantially parallel to each other and to the support surface 363 as illustrated in FIGS. 21 and 23. The first and second side walls 364, 366 are capable of being positioned in such a manner because the hinge axis about which the first side wall 364 pivots is at an elevationally different position than the hinge axis about which the second side wall 366 pivots. That is, the hinge axis of the first hinge arrangement 382 lies in a plane parallel to the planar support surface 363 and is spaced apart from the plane parallel to the planar support surface 363 in which the hinge axis of the second hinge arrangement 384 lies. Preferably, the vertical distance between the hinge axes about which the first and second side walls 364, 365 pivot is approximately equal to the thickness of the first side wall 364 as measured in a direction perpendicular to the planar support surface 363.

Figure 22:
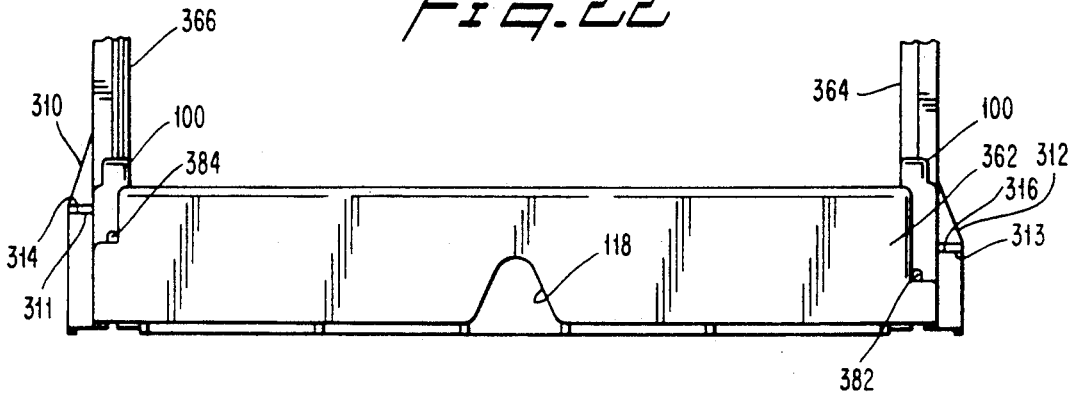
FIG. 22 is partial side view of a folding crate according to a third embodiment of the present invention showing the side walls in a vertically upright position.

The construction of the first and second side walls 364, 366 and the bottom 362 is such that the first and second side walls 364, 366 are inhibited from being folded outwardly beyond the substantially vertical position relative to the horizontal positioned bottom 362 as depicted in FIG. 22. In particular, each of the side walls 364, 366 includes a gusset 310, 312, positioned at a lower end of each side wall 364, 366, respectively, that restricts additional pivoting movement of each side wall 364, 366.

Figure 20:
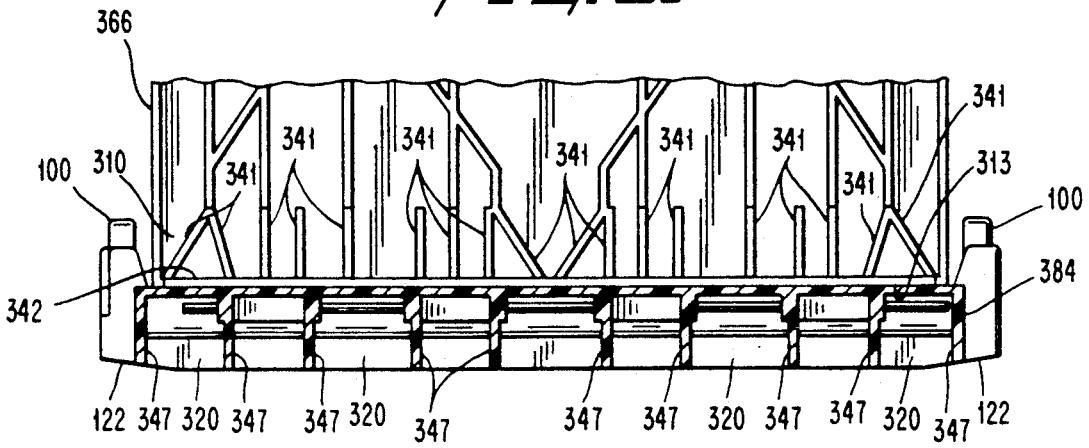
FIG. 20 is a partial cross-sectional view of the folding crate according to a third embodiment of the present invention along the lines 20—20 of FIG. 19.

The gusset 310 of the second side wall 366 as shown in FIG. 20 is comprised of a series of ribs 341 extending upward from a planar land 342 and intersecting with the outside surface of the second side wall 366. Since ribs 341 extend upward and into the outside surface of the second side wall 364, the gusset 312 takes on a substantially triangular shape as viewed from the side as in FIGS. 18 and 21-23. The planar land 342 is disposed along the entire edge of the second side wall 366 at the second end 372 and extends perpendicularly therefrom. The planar land 342 of the gusset 310 includes a planar abutment surface 11 such that when the second side wall 366 has been pivoted to a vertical position, the abutment surface 311 of the gusset 310 abuts against a mating planar surface 314 of the bottom 362 as shown in FIG. 22. When the two planar surfaces 311, 314 abut against one another, the second side wall 366 is thus inhibited from further pivoting movement and is thus maintained in a vertical substantially position.

The gusset 312 of the first side wall 366 is substantially identical to the gusset 310 of the second side wall 366. That is, the gusset 310 is comprised of a series of ribs 345 extending upward from a planar land 346 and intersecting with the outer surface of the first side wall 364. Since the ribs 345 extend upward and into the outside surface of the first wall 364 the gusset 310 takes on a triangular shape as viewed from the side as shown in FIGS. 18 and 21-23. The planar land 346 is disposed along the entire edge of the first side wall 364 and extends perpendicularly therefrom. The planar land 346 includes a planar abutment surface 313 such that when the second side wall has been pivoted to a vertical position, the abutment surface 313 is abutted with a mating planar surface 316 of the bottom 362 to thus prevent further pivoting movement of the second side wall 366. In this manner, both the first and second side walls 364, 366 are inhibited from being folded outwardly beyond a substantially vertical position relative to the bottom 362.

As with the side walls 64, 66 and bottom 62 of the second embodiment of the present invention, the side walls 364, 366 and the bottom 362 of the third embodiment are configured to support the load that develops when each crate is filled with packages and then the crates are stacked on top of one another. However, the third embodiment of the present invention is configured to further facilitate proper weight distribution and to further ensure proper crate strength. Referring to FIG. 20, beneath the second hinge arrangement 324, the bottom 362 is configured to have a plurality of vertical ribs 347 disposed along the side of the bottom 362 that extend from the second hinge arrangement 384 to a bottom surface of the bottom 362. The ribs form at least four slots 320 that are configured to receive a corresponding finger protrusion 304 of one of the side walls when crates are loaded and stacked upon each other. More specifically, when a plurality of loaded crates are stacked on top of one another, the finger protrusions 303 of each side wall 364, 366 in an underlying crate are received in a corresponding slot 320 of the bottom 362 when the crates are stacked upon one another. The ribs 347 then come into contact with the top edges of the side walls 364, 366 in the area between each finger protrusion 303 and are thus supported thereby. In this manner, adequate weight distribution and crate support is provided.

The third embodiment of the present invention includes a plurality of projections 100 that are received in corresponding hollow receptacles 340 of the above stacked crate in order to facilitate the stacking of the crates when the crates are oriented in a folded configuration. However, in the third embodiment, as shown in FIG. 23, at least one of the hollow receptacles 340 located on the underside of the bottom 362 at the corners of the crate includes a post 341 extending substantially the height of the receptacle 340. Furthermore, in the third embodiment, at least one of the corners on the top side of the bottom 362 does not have a protrusion 100. Consequently, during stacking of folded crates of the third embodiment, as shown in FIG. 23, the hollow receptacle 340 of the above stacked crate not having a protrusion 100 must be situated beneath the hollow receptacle 340 of the above stacked crate having the post 341. If an operator attempts to stack the crate such that a corner having a protrusion 100 is positioned beneath the hollow receptacle 340 of the above stacked crate having the post 341, the protrusion 100 will be prevented from being received by the hollow receptacle 340 due to the post 141 and the operator will be forced to re-orient the crate for correct stacking. In this manner, the alignment of each crate within a stack is maintained.

In further similarity to previously described embodiments, the third embodiment includes a cut-out portion 118 for which a dragging hook can be positioned so as to permit an entire stack of crates to be dragged across the floor. Further, the third embodiment includes inclined portions 122 on the underside surface of the bottom 362 to facilitate the moving of the stack of crates across the floor surface. The outer faces of the side walls in the third embodiment also include at least two grooves 128 that extend across the entire width thereof for receiving straps 132 which secure the packages 200 within the crate.

In addition, the length of the first side wall 364 is shorter than the length of the second side wall 366 so as to permit the crates to be stacked on top of one another in a level and stable manner. However, it is understood that the hinge axes of both the first and second hinge arrangements 382, 384 could be positioned at the same height thus enabling the length of the first and second side walls 364, 366 to be equal. However, to yet preserve the stacking capability of the crates in the folded configuration, the axes of the first and second hinge arrangements must be positioned at a suitable height above the planar surface 363 of the bottom 362 to allow sufficient room for folding the two equal height side walls. That is, the height of the axes of a first and second hinge arrangements 382, 384 must provide sufficient depth relative to the planar surface 363 so that the first and second side walls 364, 366 may be folded inwardly such that the protrusions 100 extend above the first and second side walls in the folded condition.

The crates 20, 60, 360 according to the first, second and third embodiments of the present invention are adapted to receive any type of packages. However, the second and third embodiments are especially well suited to receive gable-top type packages 200. As seen in FIGS. 16 and 18, the crate 60 and the crate 360 are preferably constructed such that the uppermost strap 132 is positioned below the top of the gable-top type packages 200. Moreover, the handle openings in the first and second side walls, respectively are positioned at or above the level of the gable-top type portion of the packages 200 so that an individual can place his hands through the handle openings without interference from the packages 200.

The folding crates according to the first, second and third embodiments of the present invention are preferably manufactured from polypropylene, although other types of material such as polyphenylene-oxide and polycarbonate could be employed.

The principles, preferred embodiments and modes of operation of the present invention have been described in the foregoing specification. However, the invention which is intended to be protected is not to be construed as limited to . the particular embodiments disclosed. Further, the embodiments described herein are to be regarded as illustrative rather than restrictive. Variations, changes and equivalents may be made by others without departing from the spirit of the present invention. Accordingly, it is expressly intended that all such variations, changes and equivalents which fall within the spirit and scope of the present invention as defined in the claims, be embraced thereby.

What is claimed is:

1. A folding crate for holding packages comprising:

a bottom having a substantially planar support surface for supporting packages;

a first and a second side wall and two opposing open sides first hinge means on said bottom for swinging said first side wall relative to said bottom about a first hinge axis between a folded position and an unfolded position;

a second hinge means on said bottom for swinging said second side wall relative to said bottom about a second hinge axis between a folded and an unfolded position, said second hinge axis being substantially parallel to said first hinge axis and said first and second hinge axes being located on opposite sides of said bottom, said side walls extending substantially perpendicular to said planar support when in said unfolded position; and strap means connecting said first and second side wall to each other across said two opposing open side for securing articles on said planar support surface between said side walls and arranged for resisting swinging of said side walls away from each other when said side walls are in said unfolded position, said strap means being in tension so as to urge said side walls towards each other into constant contact with said articles.

2. The folding crate according to claim 1, wherein said side walls and said bottom include stop means for restricting swinging of said side walls beyond a position substantially perpendicular to said support surface.

3. The folding crate according to claim 1, wherein said side walls are substantially rectangular and have an edge spaced from said hinge means, said bottom having recesses for receiving said side wall edges to allow stacking of said crates when said side walls are unfolded.

4. The folding crate according to claim 1, further including means for locking the first side wall in the folded position and means for locking the second side wall in the folded position.

5. The folding crate according to claim 4, wherein said means for locking the first side wall in the folded position includes an aperture positioned in a side of the bottom and a projection extending rom an inner face of the first side wall, said aperture in the side of the bottom and the projection extending rom the inner face of the first side wall being positioned such that when the first side wall is folded toward the bottom, the projection extending from the inner face of the first side wall can be positioned in the aperture in the side of the bottom.

6. The folding crate according to claim 4, wherein said means for locking the second side wall in the folded position includes an aperture positioned in the first side wall and a projection extending from an inner face of the second side wall, said projection extending from the inner face of the second side wall and the aperture in the first side wall being positioned such that when the first and second side walls are folded down toward the bottom with the first side wall being positioned below the second side wall, the projection extending from the inner face of the second side wall can be positioned in the aperture in the first side wall.

7. The folding crate according to claim 1, wherein said first hinge means includes a plurality of spaced openings in one side of the bottom, a plurality of hollow knuckles extending from one end of the first side wall, each of which are positioned in one of said openings in said one side of the bottom, a longitudinal hole extending through said one side of the bottom and a pin extending longitudinally through said longitudinal hole in the one side of the bottom and through the hollow knuckles extending from the first side wall, said second hinge means including a plurality of spaced openings in an opposite side of the bottom, a plurality of hollow knuckles extending from one end of the second side wall, each of which are positioned in one of said openings in the opposite side of the bottom, a longitudinal hole extending through said longitudinal hole in the opposite side of the bottom and through the hollow knuckles extending from the second side wall.

8. The folding crate according to claim 1, further including means for aligning the crate with another crate during stacking when the first and second side walls are folded inwardly toward the bottom.

9. The folding crate according to claim 8, wherein said means for aligning the crate with another crate during stacking includes a plurality of projections extending upwardly from sides of the bottom.

10. The folding crate according to claim 9, wherein said bottom includes hollow portions at the underside of the corners of the crate into which projections extending from corners of a bottom of an underlying crate can be fitted during stacking when the side walls are folded inwardly.

11. The folding crate according to claim 1, wherein said first side wall has a handle opening that extends therethrough near an end of the first side wall that is positioned away from said bottom, and said second side wall has a handle opening that extends therethrough near an end of the second side wall that is positioned away from said bottom, said handle openings serving to facilitate lifting of the crate when the first and second side walls are positioned in an upright position.

12. The folding crate according to claim 1, wherein at least one outer side face of the bottom has a cut-out portion that opens to an underside of the bottom into which a dragging hook can be positioned for facilitating movement of a stack of crates across a floor.

13. The folding crate according to claim 12, wherein a portion of the underside surface of the bottom located opposite to the cut-out portion is inclined to further facilitate movement of a stack of crates across a floor.

14. The folding crate according to claim 1, further including means for inhibiting the first and second side walls from folding outwardly beyond a substantially vertical position.

15. The folding crate according to claim 14, wherein said means for inhibiting the first and second side walls from folding outwardly beyond a substantially vertical position includes an end surface of the first side wall contacting an upper surface of an upstanding side of the bottom, and an end surface of the second side wall contacting an upper surface of an oppositely positioned upstanding side of the bottom.

16. The folding crate according to claim 14, wherein at least one groove is positioned in an outer surface of said first and second side walls, the at least one groove in the first side wall being aligned with the at least one groove in the second side wall for permitting said strap means to encircle the side walls and be positioned in the groove in each side wall.

17. A folding crate for holding packages comprising:

a bottom;

a first and a second side wall and two opposing open sides first hinge means for hingedly connecting said first side wall to said bottom;

second hinge means for hingedly connecting said second side wall to said bottom;

means forming a portion of said first side wall and said bottom for inhibiting said first side wall from folding outwardly beyond a substantially vertical position; and means forming a portion of said second side wall said bottom for inhibiting said second side wall from folding outwardly beyond a substantially vertical position.

means for stacking a crate upon another crate when said first and second side walls are unfolded, said means for stacking including first and second groove means for receiving a top edge of a first and second side wall of an underlying crate, respectively, said first and second groove means being disposed beneath said first and second hinge means, respectively, on an underside of said bottom; strap means connecting said first and second side walls to each other across said two opposing open sides for securing articles on said planar support surface between said side walls and arranged for resisting swinging of said side walls away from each other when said side walls are in said unfolded position, said strap means being in tension so as to urge said side walls towards each other into constant contact with said articles.

18. The folding crate according to claim 17, wherein said first and second groove means are each comprised of a hollow underside portion for transmitting a load of said crate to said top edge of each of said first and second side walls of said underlying crate.

19. The folding crate according to claim 18, wherein each of said first and second side walls includes an end face that mates with an upper surface of an upstanding wall of said bottom so as to support a portion of a load of an above stacked crate as transmitted from said hollow underside portion to said top edge of each of said first and second side walls.

20. The folding crate according to claim 17, wherein said means for inhibiting the first side wall from folding outwardly beyond a substantially vertical position includes an end surface of the first side wall contacting an upper surface of an upstanding side of the bottom, and said means for inhibiting the second side wall from folding outwardly beyond a substantially vertical position includes an end surface of the second side wall contacting an upper surface of an upstanding side of the bottom.

21. The folding crate according to claim 17, wherein said first hinge means includes a plurality of spaced openings in one side of the bottom, a plurality of hollow knuckles extending from one end of the first side wall, each of which are positioned in one of said openings in said one side of the bottom, a longitudinal hole extending through said one side of the bottom and a pin extending longitudinally through said longitudinal hole in the one side of the bottom and through the hollow knuckles extending from the first side wall, said second hinge means including a plurality of spaced openings in an opposite side of the bottom, a plurality of hollow knuckles extending from one end of the second side wall, each of which are positioned in one of said openings in the opposite side of the bottom, a longitudinal hole extending through said opposite side of the bottom and a pin extending through said longitudinal hole in the opposite side of the bottom and through the hollow knuckles extending from the end of the second side wall.

22. The folding crate according to claim 17, further including means for aligning the crate with another crate during stacking when the first and second side walls are folded inwardly toward the bottom.

23. The folding crate according to claim 22, wherein said means for aligning the crate with another crate during stacking includes a plurality of projections extending upwardly from sides of the bottom.

24. The folding crate according to claim 17, wherein at least one outer side face of the bottom has a cut out portion that opens to an underside of the bottom into which a dragging hook can be positioned for facilitating movement of a stack of crates across a floor.

25. The folding crate according to claim 24, wherein a portion of the underside surface of the bottom located opposite to the cut-out portion is inclined to further facilitate movement of a stack of crates across a floor.

26. A folding crate for holding packages comprising:

a bottom;

a first side wall;

first hinge means for hingedly connecting said first side wall to said bottom;

a second side wall;

second hinge means for hingedly connecting said second side wall to said bottom;

means forming a portion of said first side wall and said bottom for inhibiting said first side wall from folding outwardly beyond a substantially vertical position; and means forming a portion of said second side wall and said bottom for inhibiting said second side wall from folding outwardly beyond a substantially vertical position means for stacking a crate upon another crate when said first and second side walls are unfolded, said means for stacking including first and second groups of slots for receiving corresponding fingers of a top edge of a first and second side wall of an underlying crate, respectively, said first and second group of slots being disposed beneath said first and second hinge means on an underside of said bottom, respectively.

27. A folding crate according to claim 26, wherein said first and second groups of slots are formed from a plurality of ribs extending from said first and second hinge means to a bottom surface of said bottom, respectively.

28. A folding crate according to claim 27, wherein said ribs extend a length sufficient to engage a top surface of a corresponding side wall so as to transmit a load of said crate to said side wall, said top surface being positioned between said fingers.

29. A folding crate according to claim 26, wherein said means for inhibiting the first side wall from folding outwardly beyond a substantially vertical position includes a first gusset comprising a plurality of ribs that extend from a first planar land and intersect an outside surface of said first side wall, said first planar land oriented perpendicularly from said first side wall, said means for inhibiting the first side wall further including a first planar surface disposed on said bottom for mating with said first planar land when said first side wall is oriented substantially vertically, and said means for inhibiting the second side wall from folding outwardly beyond a substantially vertical position includes a second gusset comprising a plurality of ribs that extend from a second planar land and intersect an outside surface of said second side wall, said second planar land oriented perpendicularly from said second side wall, said means for inhibiting the second side wall further including a second planar surface disposed on said bottom for mating with said second planar land when said second side wall is oriented substantially vertically.

30. A folding crate according to claim 26, further including means for aligning the create with another crate during stacking when the first and second side walls are folded inwardly toward the bottom.

31. A folding crate according to claim 30, wherein said means for aligning the crate with another crate includes a three projections extending upwardly from sides of the bottom at three corners of said bottom.

32. A folding crate according to claim 31, wherein a hollow receptacle for receiving a projection from an underlying crate is positioned on the underside of said three corners of said bottom and wherein a hollow receptacle having a post is positioned on the underside of a fourth corner of said bottom.

* * * * *